US005504275A

United States Patent [19]

Scramoncin

[11] Patent Number: 5,504,275

[45] Date of Patent: Apr. 2, 1996

[54] CRIMP CONTACT FOR CONNECTING ELECTRICAL WIRES

[76] Inventor: Ernesto Scramoncin, via Emiliani n. 18/20, Bassano Del Grappa (Vicenza), Italy

[21] Appl. No.: 382,199

[22] Filed: Feb. 1, 1995

[30] Foreign Application Priority Data

Feb. 22, 1994 [IT] Italy ..... VR94U0013

[51] Int. Cl.[6] ..... H01R 4/18

[52] U.S. Cl. ..... 174/84 C; 174/94 R; 439/877; 439/882; 439/887

[58] Field of Search ..... 174/84 C, 94 R; 439/877, 882, 884, 886, 887, 889

[56] References Cited

U.S. PATENT DOCUMENTS

| | | | |
|---|---|---|---|
| 2,449,496 | 9/1948 | Matan | 287/64 |
| 3,020,333 | 2/1962 | Bangert et al. | 174/94 R |
| 3,034,195 | 5/1962 | Leclabart | 28/78 |
| 3,226,471 | 12/1965 | Buchanan et al. | 174/87 |
| 3,523,173 | 8/1970 | Lull | 219/91 |
| 3,541,227 | 11/1970 | Bendrick | 174/94 R |
| 3,835,241 | 9/1974 | Masterson et al. | 174/87 |
| 4,087,889 | 5/1978 | Ohba et al. | 24/129 W |

FOREIGN PATENT DOCUMENTS

| | | | |
|---|---|---|---|
| 1580258 | 9/1969 | France | 174/84 C |

*Primary Examiner*—Morris H. Nimmo
*Attorney, Agent, or Firm*—Browdy and Neimark

[57] ABSTRACT

The present invention concerns a crimp contact used for connecting electrical wires. The said crimp contact is of the type consisting of a strip of electrically conductive material, for example copper, crimped to form a substantially square shape, with rounded corners and edges. According to the present invention, the electrically conductive base material is backed with a layer of soldering material, for example tin, in various shapes and size. In addition, solder flux may be advantageously placed between the soldering material and the electrically conductive base.

9 Claims, 2 Drawing Sheets

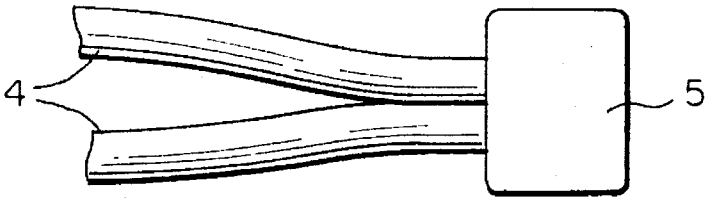
FIG. 1
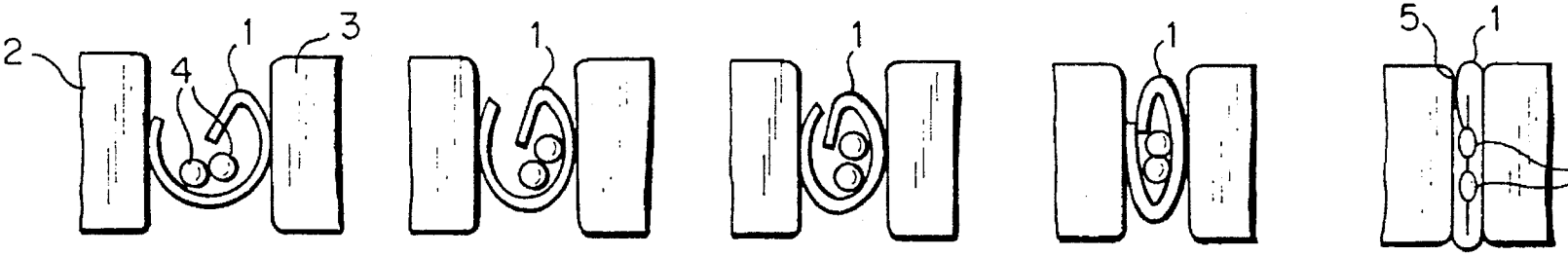
FIG. 2
FIG. 3
FIG. 4
FIG. 5
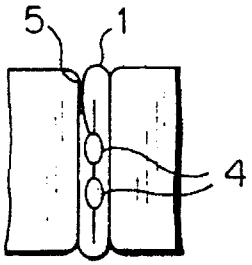
FIG. 6

CRIMP CONTACT FOR CONNECTING ELECTRICAL WIRES

BACKGROUND OF THE INVENTION

The present invention concerns a crimp contact used for connecting electrical wires.

The contact disclosed is of the type consisting of a strip of electrically conductive material designed to be crimped so as to form a substantially square shape and to grip one or more wires, whether enamelled or not, between its crimped ends. This type of contact is used mainly for connecting wires in electric motors, transformers and other electrical units.

As is known, contacts of this type are usually coated with insulating material and must fit easily into the slots or seats of electrical units, which are often extremely small.

The contacts known to prior art have sharp edges and pointed corners and are relatively large sized (approximately 8 to 10 mm long and 4 to 5 mm wide). As a result, they have two principal disadvantages.

First of all, the angular shape makes them difficult to insulate since the insulating material applied to the contacts tends to tear (or fails to be applied properly) at the sharp edges and corners of the contacts themselves.

Secondly, because of their relatively large size, crimp contacts cannot be used in the place of ordinary soldered contacts or preformed pressure fitted contacts. In addition the space for contacts inside electrical units is often insufficient for crimp contacts of this kind.

A crimp contact smaller In size than previous ones and with rounded corners and edges has been developed to overcome these disadvantages. This crimp contact formed the subject-matter of Italian patent application No. VR91U000031.

The latter crimp contact, although it overcomes the disadvantages of the ones known previously, itself presents certain disadvantages. Like the previous ones, this contact too is made of a single material (usually copper or aluminum) and is applied to the wires by a simple hot crimping operation, that is to say, by heating the copper strip so as to melt or burn the enamel coating of the wires and bending the ends of the strip in such a way as to form the crimp contact.

This method, however, does not guarantee a perfect and reliable contact between the wires under all conditions. A poor contact will result, for example, when the contact is not handled with sufficient care or is applied to a single wire (in which case the wire tends to come loose at the slightest jerk or accidental pull).

The principal aim of the present invention is to eliminate the disadvantages of the crimp contacts known to prior art by providing a crimp contact capable of guaranteeing a perfect, reliable contact between the wires it connects, under all conditions of use.

Another aim of the invention is to provide a crimp contact that has negligible electrical resistance and that is very economical to make.

SUMMARY OF THE INVENTION

These and other aims are all achieved by the crimp contact forming the subject-matter of the present invention, which is of the type consisting of a strip of electrically conductive material crimped to form a substantially square shape, with rounded corners and edges, wherein the base material forming the aforesaid strip of electrical conductor is backed with a soldering material.

BRIEF DESCRIPTION OF THE DRAWINGS

Further characteristics and advantages of the invention are apparent from the detailed description which follows, with reference to the accompanying drawings, which illustrate preferred embodiments of the invention by way of example and in which:

FIG. 1 is a plan view of the contact disclosed by the present invention connecting two wires;

FIGS. 2 thru 6 illustrate the steps by which the strip forming the crimp contact disclosed herein is compressed onto a pair of wires;

DESCRIPTION OF THE PREFERRED EMBODIMENTS

Figure 7:
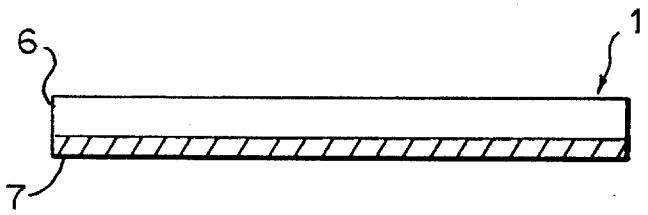
FIGS. 7 thru 13 illustrate different forms which the strip forming the crimp contact disclosed herein may assume.

With reference to the drawings listed above, the numeral 1 indicates a metal strip, previously bent into a semicircular shape as shown in FIG. 2 by an appropriate tool (not illustrated) and then inserted between jaws 2 and 3 of a hot crimping machine.

Wires 4 are inserted into the hollow defined by the bent strip 1 and the strip 1 is then laterally compressed as shown in FIGS. 2 thru 6 which illustrate different stages in the compression operation. The strip 1 then assumes the shape illustrated in FIGS. 1 and 6. The numeral 5 indicates the crimp contact formed by the strip 1 after being shaped and compressed.

According to the present invention, the strip 1 is made of an electrically conductive base material 6 (for example copper) backed with a soldering material (for example tin or silver). This method, in addition to crimping the contact, also forms a soldered joint.

FIGS. 7 thru 13 are cross sections of different forms which the strip 1 may have before being finished, that is, before it is bent over and compressed to form the crimp contact 5.

In FIG. 7 the two superimposed layers 6 and 7, when they reach the hot crimping area, are not attached but simply placed one over the other.

Figure 8:
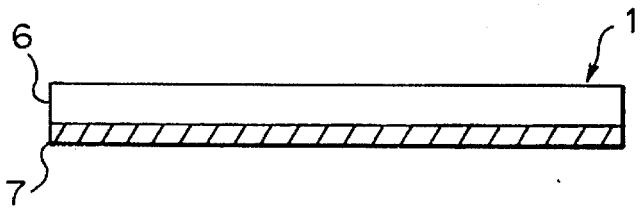

In FIG. 8, the two superimposed layers 6 and 7 are attached to each other.

Figure 9:
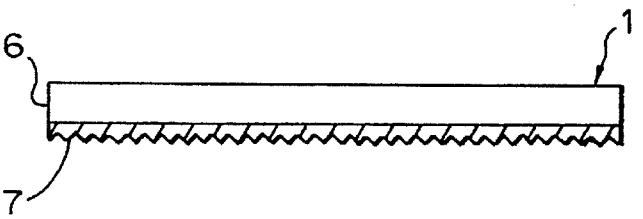

In FIG. 9, the layer of soldering material 7 has a corrugated surface to improve the grip of the strip 1 on the wires 4.

Figure 10:
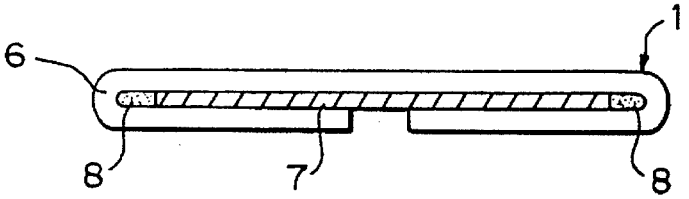

In FIG. 10, the layer 7 is a flat lamina placed inside the hollow formed by the layer 6 which is bent into a flattened C shape.

Figure 11:
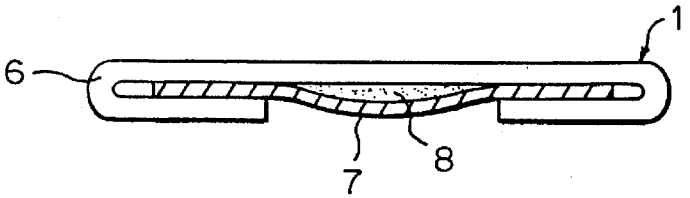

FIG. 11 is similar to the strip ilustrated in FIG. 10 but the layer of soldering material 7 is bowed.

Figure 12:
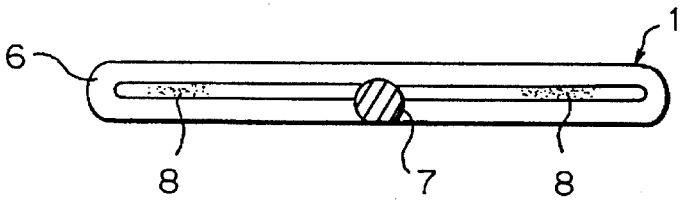

In FIG. 12, the soldering material 7 is a wire or circular bar.

Figure 13:
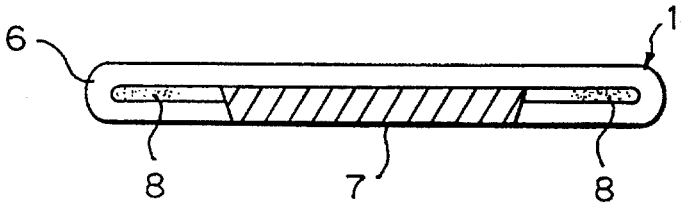

In FIG. 13, the layer 7 has a quadrangular, trapezoidal section.

The numeral 8 indicates solder flux in powder or paste form placed between the base conductor 6 and the soldering material 7 (see FIGS. 10, 11, 12 and 13). The function of the flux is to improve the soldering by eliminating the so-called "cool spots".

It should also be noted that the strip 1 may have longitudinal ribbing (not illustrated) designed to increase the mechanical strength of the contact 5 and to stop it from accidentally opening. The crimp contact disclosed by the present invention may therefore be used to make perfect electrical connection between wires that are simply enamelled.

Moreover, it provides a contact whose electrical resistance is negligible and which can withstand all kinds of stress, whether simply mechanical (caused by vibrations, for example) or thermal (caused by high operating temperatures) and therefore reduces considerably the time and cost of manufacturing electric motors, transformers and other electric machines, since the crimp contact 5 made in this way can be quickly and easily fitted to the contact base (of the power supply, for example) which thus becomes a type of female connector. From this point of view, the contact 5 disclosed also advantageously assumes the function of a connecting pin.

What is claimed:

1. A crimp contact of the type consisting of a strip of electrically conductive material crimped to form a substantially square shape, with rounded corners and edges, characterized in that the material forming the aforesaid strip of electrical conductor is backed with a soldering material.

2. The crimp contact according to claim 1 wherein the said strip consists of two superimposed layers, the base layer being an electrical conductor and the other layer being a soldering material.

3. The crimp contact according to claim 2 wherein the said two superimposed layers are attached to one another to form a single body.

4. The crimp contact according to claim 2 wherein the said layer of soldering material has a corrugated surface.

5. The crimp contact according to claim 1 wherein the said electrically conductive base and the said layer of soldering material forming the said strip present profiles :hat are approximately in the shape of a flattened C and of a flat lamina, respectively, where the said flat lamina is inserted between the hollow formed by the flattened C.

6. The crimp contact according to claim 5 wherein the said lamina inserted between the hollow formed by the flattened C presents a bowed profile.

7. The crimp contact according to claim 5 wherein the said lamina inserted between the hollow formed by the flattened C presents a quadrangular profile.

8. The crimp contact according to claim 1 wherein the said electrically conductive base and the said layer of soldering material forming the said strip present profiles that are approximately in the shape of a flattened C and circular, where the circular profile is that of the soldering material in the form of a wire or bar.

9. The crimp contact according to claim 1 wherein there is flux placed between the said soldering material and the said electrically conductive base.

* * * * *